US010207395B2

(12) United States Patent
Sakamoto

(10) Patent No.: US 10,207,395 B2
(45) Date of Patent: Feb. 19, 2019

(54) VEHICLE BODY MANUFACTURING APPARATUS

(71) Applicant: Fuji Jukogyo Kabushiki Kaisha, Tokyo (JP)

(72) Inventor: Noboru Sakamoto, Tokyo (JP)

(73) Assignee: SUBARU CORPORATION, Tokyo (JP)

( * ) Notice: Subject to any disclaimer, the term of this patent is extended or adjusted under 35 U.S.C. 154(b) by 107 days.

(21) Appl. No.: 14/845,155

(22) Filed: Sep. 3, 2015

(65) Prior Publication Data

US 2016/0068210 A1 Mar. 10, 2016

(30) Foreign Application Priority Data

Sep. 4, 2014 (JP) ..... 2014-180550

(51) Int. Cl.
*B25B 11/02* (2006.01)

(52) U.S. Cl.
CPC ..... *B25B 11/02* (2013.01)

(58) Field of Classification Search
CPC ..... B25B 11/02; B23K 37/04–37/047
USPC ..... 228/212–213, 44.3, 47.1, 49.1, 49.6
See application file for complete search history.

(56) References Cited

U.S. PATENT DOCUMENTS 5,011,068 A * 4/1991 Stoutenburg ..... B23K 37/047 228/4.1
6,153,853 A * 11/2000 Maruyama ..... B23K 26/04 219/121.63
6,389,698 B1 * 5/2002 Malatier ..... B62D 65/00 269/289 R
2013/0113149 A1 * 5/2013 Yeum ..... B23K 37/0443 269/59

FOREIGN PATENT DOCUMENTS

JP H 06-59851 B2 8/1994
JP 2000-190136 A 7/2000
JP 2014-129033 A 7/2014

OTHER PUBLICATIONS

JPO Decision to Grant a Patent dated Aug. 25, 2015.

* cited by examiner

*Primary Examiner* — David Bryant
*Assistant Examiner* — Nirvana Deonauth
(74) *Attorney, Agent, or Firm* — McGinn I.P. Law Group, PLLC

(57) ABSTRACT

A vehicle body manufacturing apparatus includes: side jig frames disposed respectively on the right and left sides of a vehicle body; an upper jig frame installed between the side jig frames, the upper jig frames including a pair of front and rear frame members insertable into the inside of the vehicle body through front and rear openings of the vehicle body, respectively; a connection mechanism that removably connects insertion ends of the pair of frame members; and a clamping mechanism that is held on the upper jig frame and that positions the vehicle body.

9 Claims, 9 Drawing Sheets

VEHICLE BODY MANUFACTURING APPARATUS

CROSS-REFERENCE TO RELATED APPLICATIONS

The present application claims priority from Japanese Patent Application No. 2014-180550 filed on Sep. 4, 2014, the entire contents of which are hereby incorporated by reference.

BACKGROUND

1. Technical Field

The present invention relates to vehicle body manufacturing apparatuses that weld one work of a temporarily fixed vehicle body to another work to pre-assemble the vehicle body.

2. Related Art

There have been proposed and put into practical use various techniques for assembling a vehicle body by spot welding multiple works included in the vehicle body with the works positioned.

As a vehicle body manufacturing apparatus of this type, for instance, Japanese Published Examined Patent Application Publication (JP-B) No. 6-59851 discloses a technique that uses a vehicle body manufacturing apparatus to assemble multiple types of vehicle body having shapes at clamp positions of the vehicle body in common between vehicle body models, the vehicle body manufacturing apparatus including: multiple 3 axis switching units that each serve as a clamping device for positioning with a body side and a roof and that are suspension-supported and provided on both right and left sides of an upper frame of a vehicle body assembly station; and multiple 3 axis switching units that each serve as a clamping device for positioning with a body side and an under body and that are provided on both right and left sides of a lower frame of the vehicle body assembly station.

However, as disclosed in JP-B No. 6-59851 mentioned above, in typical manufacturing apparatuses for vehicle body, clamp jigs for positioning works on a vehicle body are supported by 3 axis switching units or articulated robots that are provided on the sides of the vehicle body. Therefore, when pre-assembly welding is performed, various mechanical units for supporting the clamp jigs are disposed on the sides of the vehicle body, and this may interfere with movement of a welding gun to a welding position.

SUMMARY OF THE INVENTION

The present invention has been made in view of the above-described situation and aims to provide a vehicle body manufacturing apparatus capable of accurately positioning a work of a vehicle body while ensuring a work space on the sides of the vehicle body.

An aspect of the present invention provides a vehicle body manufacturing apparatus including: side jig frames disposed respectively on right and left sides of a vehicle body; at least one upper jig frame installed between the side jig frames, the at least one upper jig frame including a pair of front and rear frame members insertable into an inside of the vehicle body through front and rear openings of the vehicle body, respectively; a connection mechanism that removably connects insertion ends of the pair of frame members; and a clamping mechanism that is held on the at least one upper jig frame and that positions the vehicle body.

DETAILED DESCRIPTION

Figure 1:
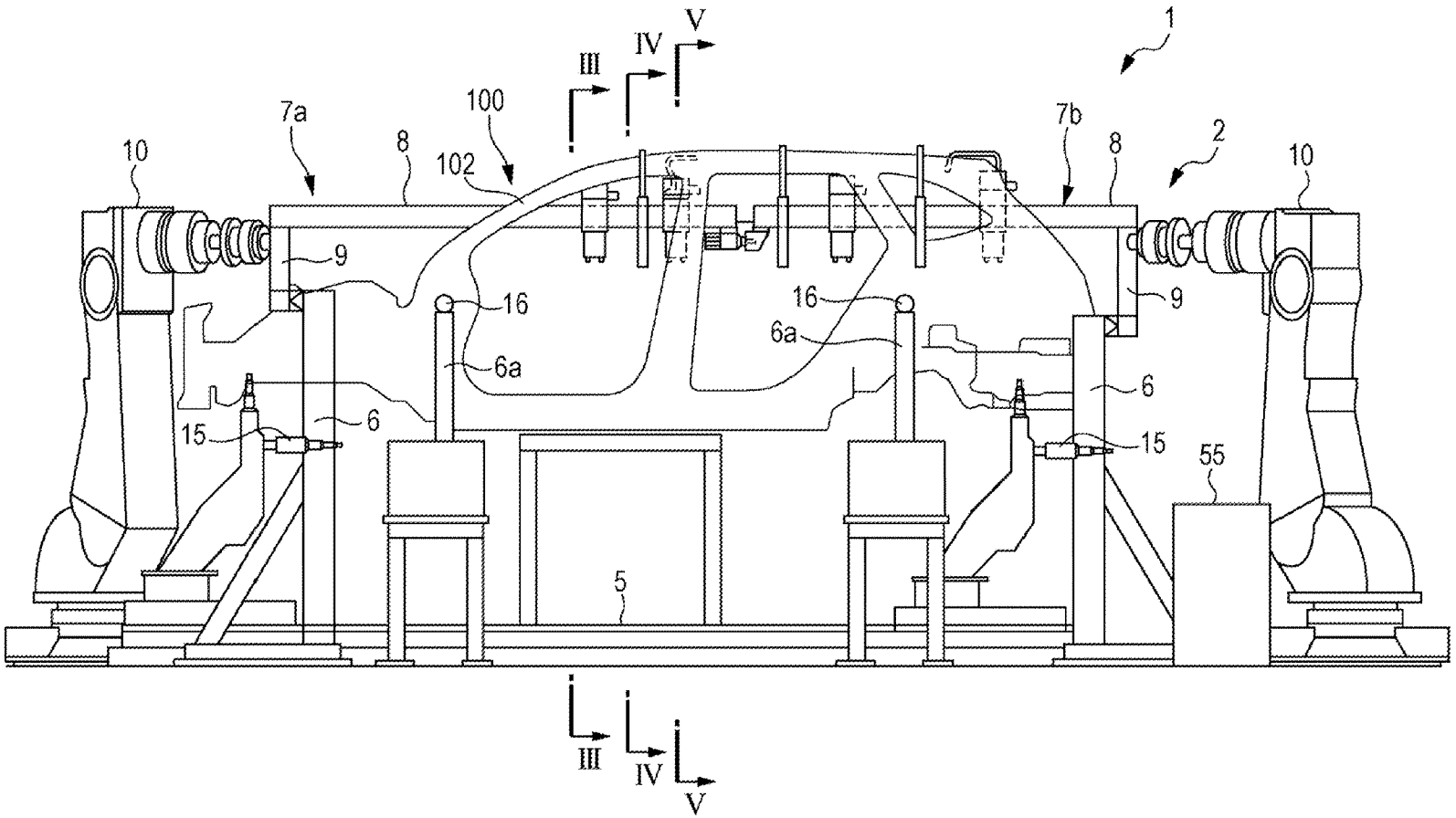
FIG. 1 is a side view illustrating the schematic configuration of a vehicle body manufacturing apparatus.
Figure 2:
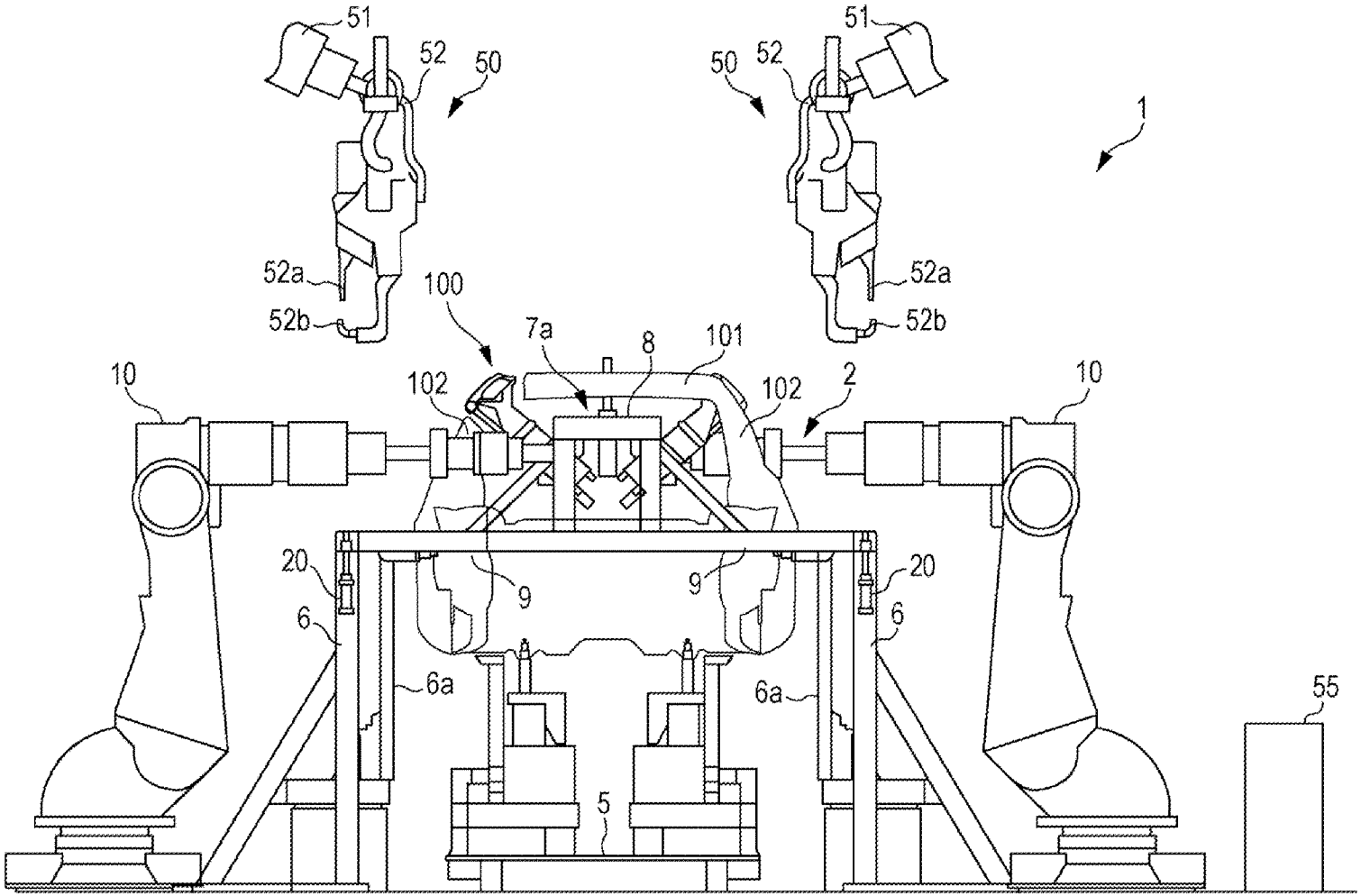
FIG. 2 is a front view illustrating the schematic configuration of the vehicle body manufacturing apparatus.
Figure 3:
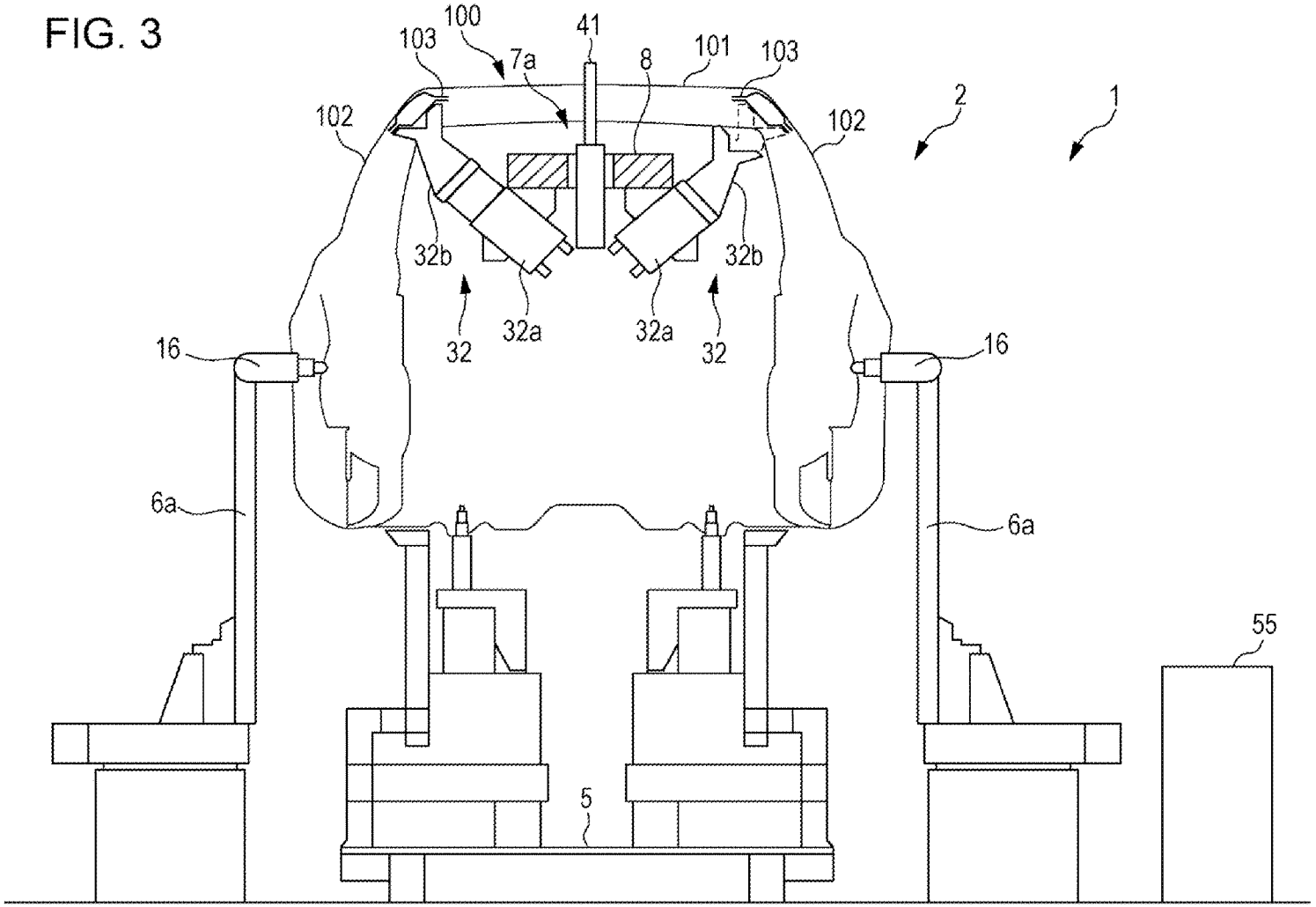
FIG. 3 is a view as seen in the direction of arrows III-III of FIG. 1.
Figure 4:
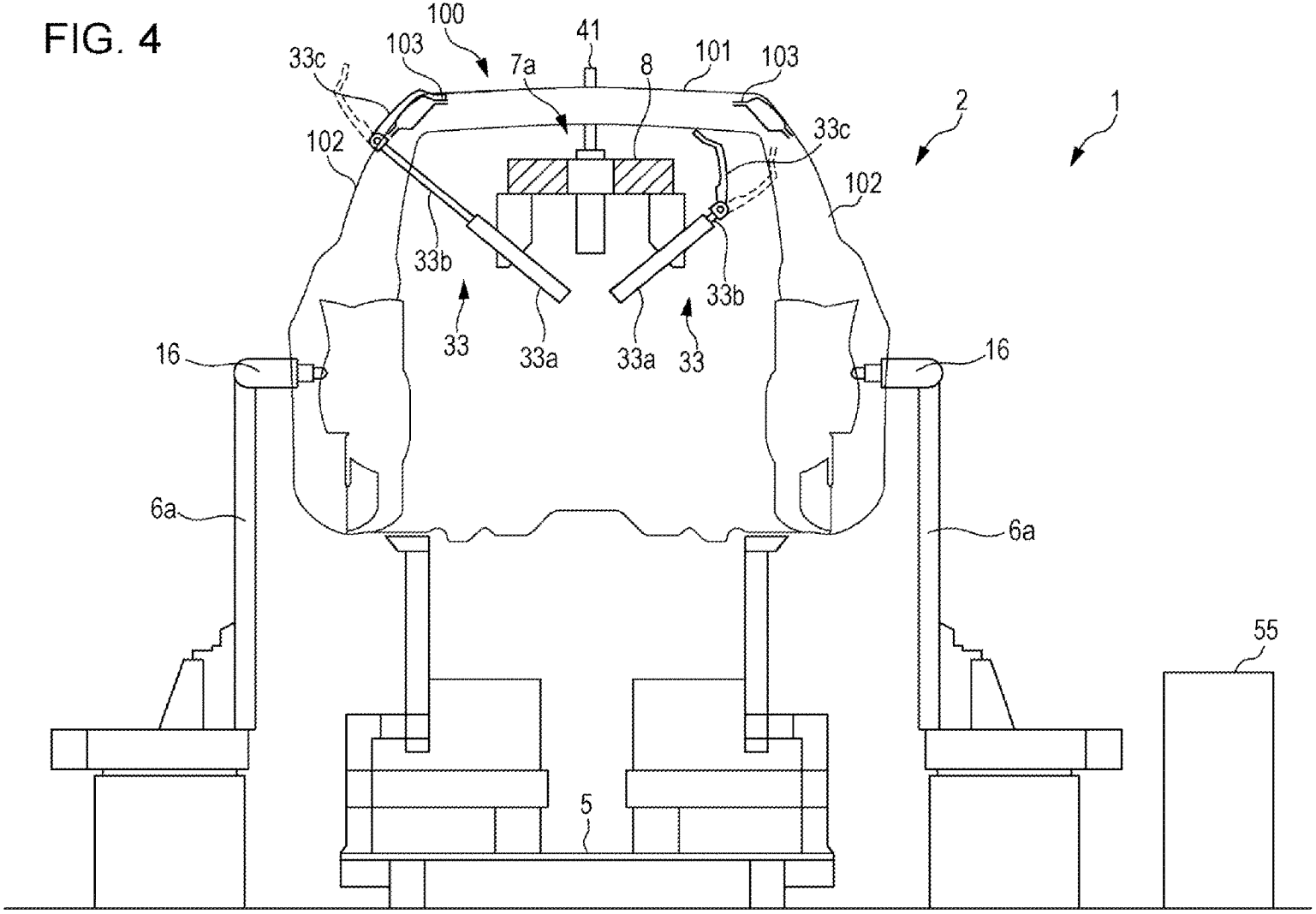
FIG. 4 is a view as seen in the direction of arrows IV-IV of FIG. 1.
Figure 5:
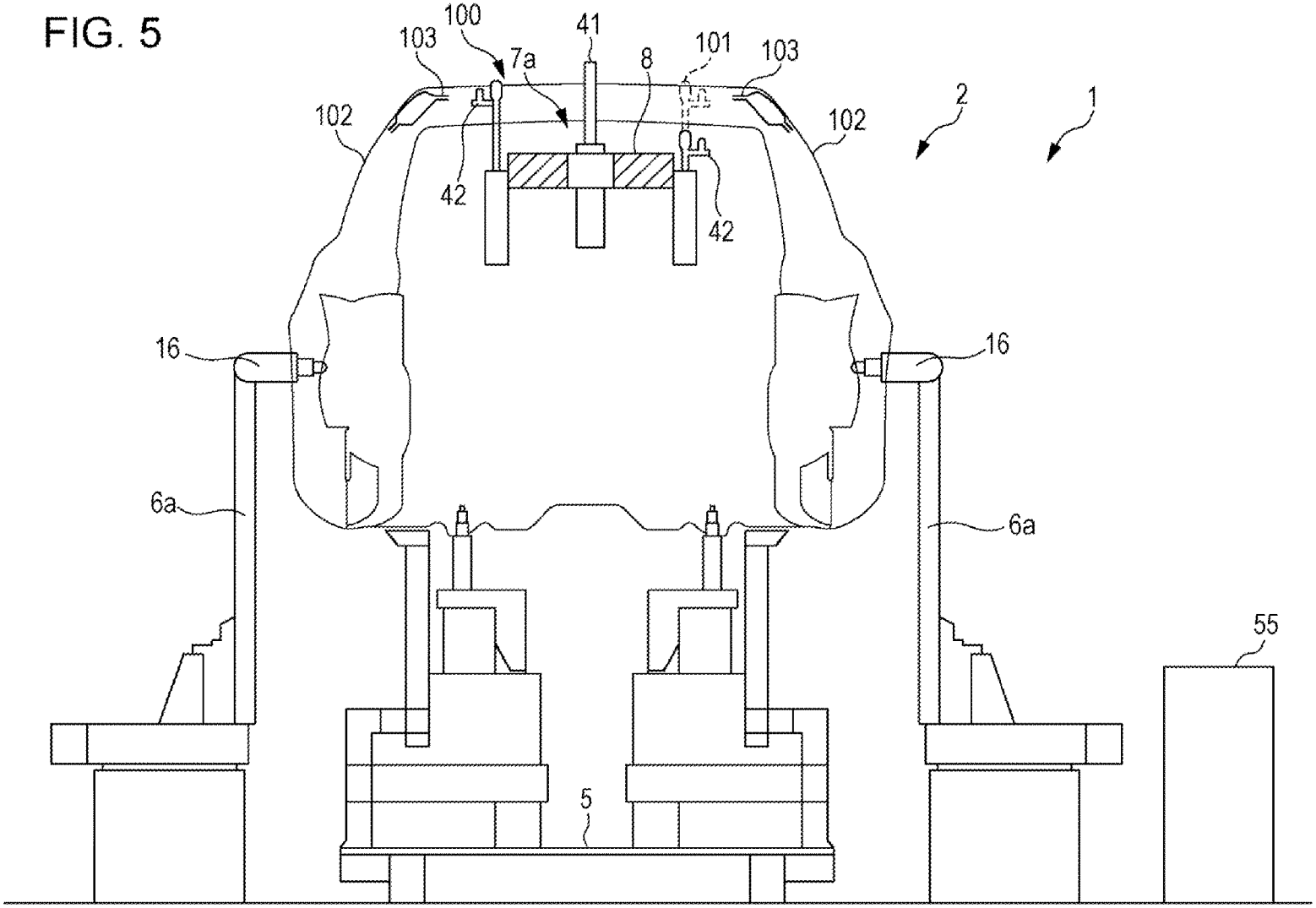
FIG. 5 is a view as seen in the direction of arrows V-V of FIG. 1.
Figure 6:
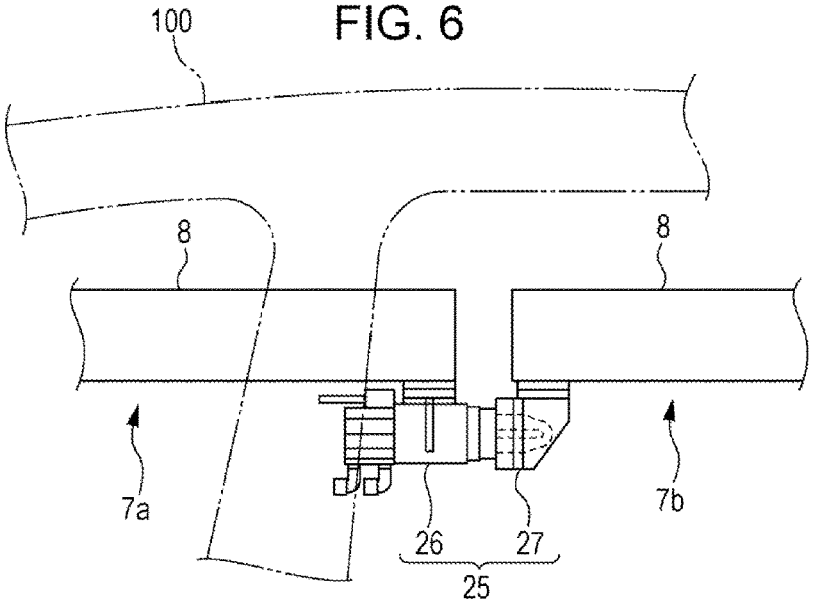
FIG. 6 is a side view illustrating a connection member.
Figure 7:
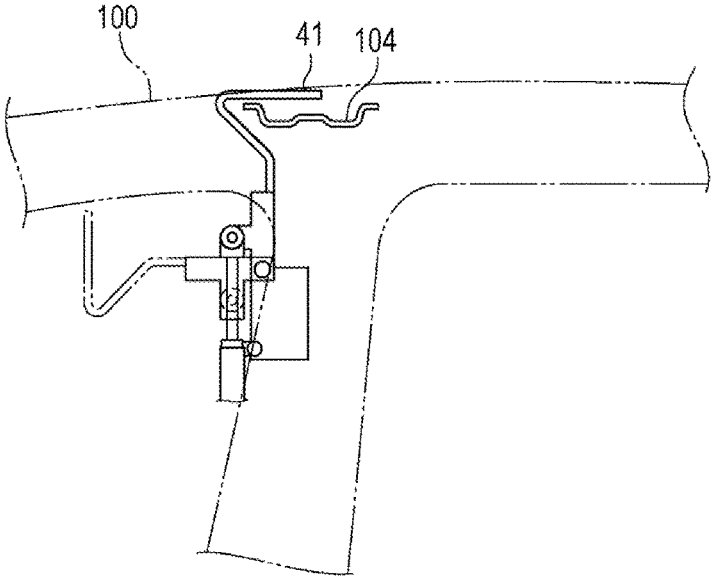
FIG. 7 is a side view illustrating an upper clamp jig.
Figure 8:
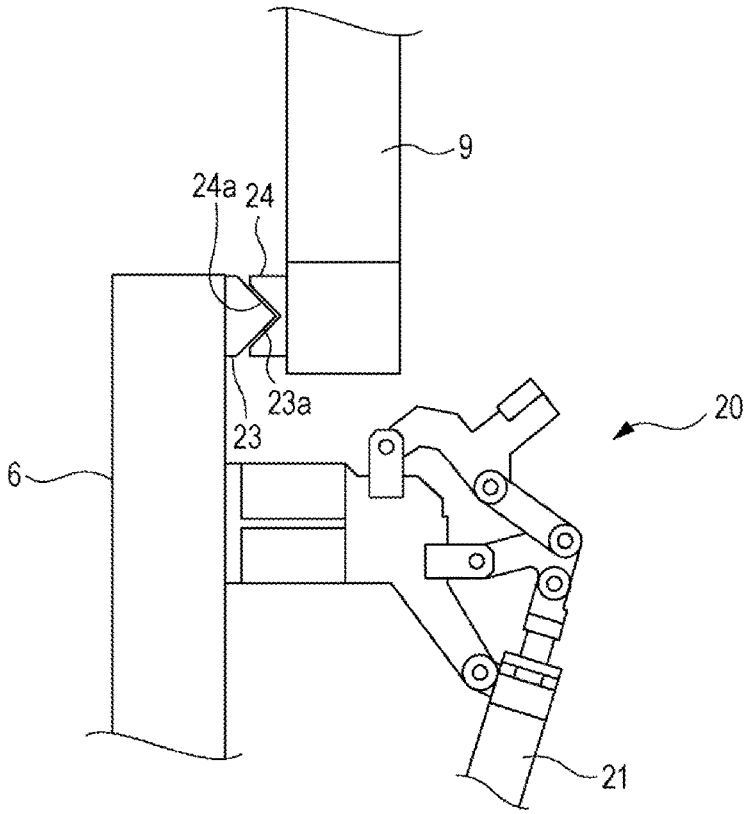
FIG. 8 is a front view illustrating the locking mechanism between a side jig frame and an upper jig frame.
Figure 9:
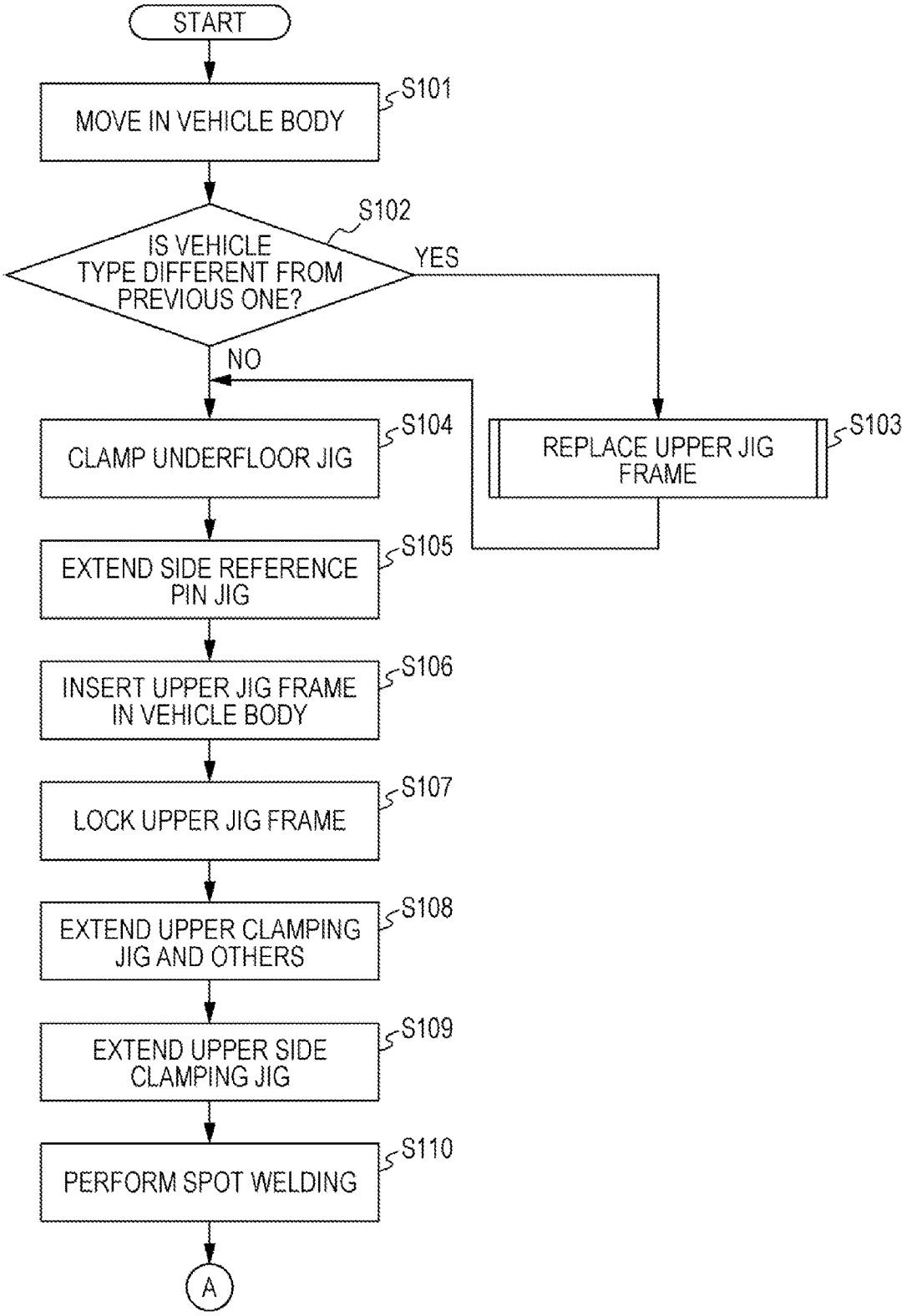
FIG. 9 is a flow chart (part 1) illustrating a pre-assembly welding process for structures including a side structure.
Figure 10:
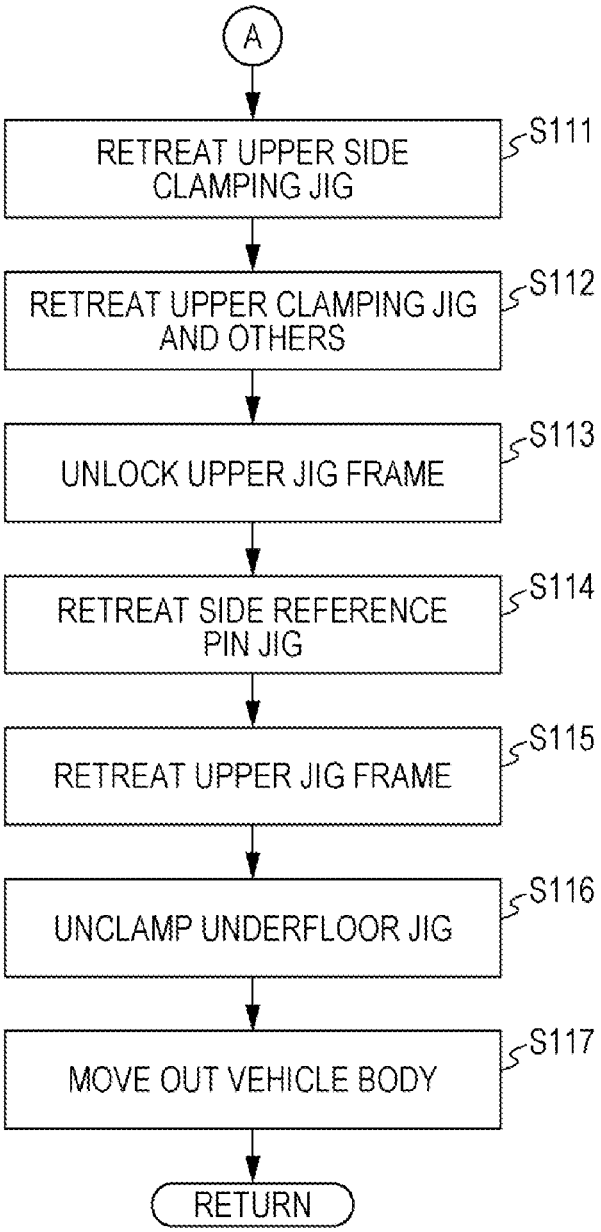
FIG. 10 is a flow chart (part 2) illustrating the pre-assembly welding process for structures including a side structure.

Hereinafter, an implementation of the present invention will be described with reference to the drawings. The drawings are related to the implementation of the present invention. FIG. 1 is a side view illustrating the schematic configuration of a vehicle body manufacturing apparatus; FIG. 2 is a front view illustrating the schematic configuration of the vehicle body manufacturing apparatus; FIG. 3 is a view as seen in the direction of arrows III-III of FIG. 1; FIG. 4 is a view as seen in the direction of arrows IV-IV of FIG. 1; FIG. 5 is a view as seen in the direction of arrows V-V of FIG. 1; FIG. 6 is a side view illustrating a connection member; FIG. 7 is a side view illustrating an upper clamp jig; FIG. 8 is a front view illustrating the locking mechanism between a side jig frame and an upper jig frame; and FIGS. 9 and 10 are a flow chart illustrating pre-assembly welding process for structures including side structures.

A vehicle body manufacturing apparatus 1 illustrated in FIGS. 1 to 4 is formed, for instance, in a stage of pre-assembly welding process set in an assembly line for the main body of the frame of an automobile. In the stage of the assembly process, for instance, a vehicle body 100 is fixedly installed (clamped) on an underfloor jig 5 and is transported in by a shuttle conveyer (not illustrated) or the like, the vehicle body 100 in which a side structure 102 that is a side structural part is temporarily fixed to each of both sides of a center structure 101 that is a lower central structural part.

The center structure 101 includes, for instance, a front wheel apron, a toe board, a front floor, and a rear wheel apron. The side structure 102 includes, for instance, a front pillar, a center pillar, a rear quarter pillar, a side rail, and a side sill.

In the stage of the assembly process, a side jig frame 6 is provided for each of the right and left side structures 102 of the vehicle body 100, the side jig frame 6 facing corresponding one of the side structures 102. A jig reference pin 15 provided in the underfloor jig 5 is engageable with corresponding one of the corresponding side jig frames 6, and the underfloor jig 5 is positioned and fixed (clamped) on the stage by the jig reference pin 15.

Part of the side jig frame 6 is a movable jig frame 6*a* that is movable closer to and away from corresponding one of the right and left side structures 102. When the vehicle body 100 is transported in as the process proceeds from another process to the present process or when the vehicle body 100 is transported out as the process proceeds from the present process to another process, each movable jig frame 6*a* is moved in a direction away from the vehicle body 100. On the other hand, when the underfloor jig 5 along with the vehicle body 100 is transported in the stage of the present process and installed and fixed, the movable jig frame 6 is moved in a direction closer to the vehicle body 100, and each side structure 102 is positioned and fixed (clamped) by the side reference pin 16 provided in the corresponding movable jig frame 6*a*.

The manufacturing apparatus 1 includes multiple types of upper jig frame front 7*a* and multiple types of upper jig frame rear 7*b* as jig frames each of which is replaceable according to the vehicle type of the transported vehicle body 100. In FIG. 1, a set of upper jig frame front 7*a* and upper jig frame rear 7*b* selected from the multiple types is illustrated. In the following description, those jig frames are collectively referred to as the upper jig frame 7 as appropriate.

The upper jig frame front 7*a* and the upper jig frame rear 7*b* are selectively transported from a jig storage (not illustrated) by respective upper jig transport robots 10.

As illustrated in FIGS. 1 and 2, the upper jig frame front 7*a* includes a jig frame body 8 that extends in a fore-and-aft direction of the vehicle body, and a leg 9 that extends to the right and left under the front end of the jig frame body 8, the upper jig frame front 7*a* having a substantially T-shaped in plan view. The upper jig frame front 7*a* is held in such a manner that the jig frame body 8 is inserted into the vehicle body 100 through a front opening (opening for the front window) of the vehicle body 100 by numerical control (NC) on the upper jig transport robots 10, and the leg 9 is installed on the side jig frame 6 and is positioned and fixed by a frame locking mechanism 20 (see FIG. 8) provided in the side jig frame 6.

Similarly, the upper jig frame rear 7*b* includes a jig frame body 8 that extends in a fore-and-aft direction of the vehicle body, and a leg 9 that extends to the right and left under the rear end of the jig frame body 8, the upper jig frame rear 7*b* having a substantially T-shaped in plan view. The upper jig frame front 7*b* is held in such a manner that the jig frame body 8 is inserted into the vehicle body 100 through a rear opening (opening for the rear window or opening for the rear gate) of the vehicle body 100 by numerical control (NC) on the upper jig transport robots 10, and the leg 9 is installed on the side jig frame 6 and is positioned and fixed by a frame locking mechanism 20 (see FIG. 8) provided in the side jig frame 6.

In the present implementation, for instance, as illustrated in FIG. 8, the frame locking mechanism 20 is, for instance, a cylinder locking mechanism that causes an air cylinder 21 to operate as an actuator. In the vicinity of the frame locking mechanism 20, a fitting member 23 formed of, for instance, a metal block or the like is fixedly provided in the side jig frame 6. In the present implementation, the fitting member 23 includes a mountain-like projection 23*a* having inclined surfaces on both sides. Also, the leg 9 of the upper jig frame 7 is fixedly provided with a fitting receiving member 24 that is to be fitted with the fitting member 23. In the present implementation, the fitting receiving member 24 has a V-shaped groove 24*a* that corresponds to the projection 23*a* of the fitting member 23. When the leg 9 of the upper jig frame 7 is fixed to the side jig frame 6 by the frame locking mechanism 20, the projection 23*a* of the fitting member 23 is fitted in the groove 24*a* of the fitting receiving member 24, and the leg 9 is guided to a connection position with the side jig frame 6, thereby achieving positioning of the upper jig frame 7 with respect to the side jig frame 6 with high accuracy.

Also, ends of the frame bodies 8 of the upper jig frame front 7*a* and the upper jig frame rear 7*b* are provided with a connection mechanism 25 that connects the ends. For instance, as illustrated in FIG. 6, the connection mechanism 25 includes a pin clamp cylinder 26 provided in the jig frame body 8 of the upper jig frame front 7*a*, and a pin hole bracket 27 provided in the jig frame body 8 of the upper jig frame rear 7*b*. When the upper jig frame front 7*a* and the upper jig frame rear 7*b* are installed between the side jig frames 6 on the right and left, the pin clamp cylinder 26 and the pin hole bracket 27 face each other in the vehicle body 100, thereby enabling the jig frame bodies 8 to be connected to each other.

In the jig frame structure 2 having this configuration, a clamping mechanism 30 is provided on the jig frame body 8 of the upper jig frame 7 for clamping mainly an upper portion of the vehicle body 100.

The clamping mechanism 30 has an upper side clamp jig 31 that clamps a work 103 from the inside of the vehicle body 100, the work 103 being included in the side rail of the vehicle body 100. The upper side clamp jig 31 includes, for instance, a pressing jig 32 that presses the work 103 of the vehicle body 100 outward from the inside of the vehicle body 100, and a regulating jig 33 that regulates outward movement of the work 103 from the vehicle body due to the pressing jig 32.

For instance, as illustrated in FIG. 3, the pressing jig 32 of the present implementation has a cylinder 32*a* that is fixed to the jig frame body 8 and pointing diagonally upward and outward in a vehicle width direction of the vehicle body 100, and a pressing member 32*b* that extends and retracts to press the work 103 by the cylinder 32*a*.

For instance, as illustrated in FIG. 4, the regulating jig 33 has a cylinder 33*a* that is fixed to the jig frame body 8 and pointing diagonally upward and outward in a vehicle width direction of the vehicle body 100, a rod 33*b* that is extendable and retractable by the cylinder 33*a*, and a retaining member 33*c* that is provided at the end of the rod 33*b* and is capable of performing bending operation.

The upper side clamp jig 31 is capable of clamping the work 103 to a setting position in such a manner that the pressing member 32*b* of the pressing jig 32 presses the work 103 outward from the inside of the vehicle body 100, and the retaining member 33*c* of the regulating jig 33 retains the work 103 from the outside of the vehicle body 100 by bending with respect to the rod 33*b*.

In addition to the upper side clamp jig 31, for instance, as illustrated in FIG. 7, at approximately the center in a vehicle width direction of the vehicle body 100, the jig frame body 8 is provided with an upper clamp jig 41 that clamps a work 104 disposed on the roof by retaining. In addition, for instance, as illustrated in FIG. 4, the jig frame body 8 is provided with an upper reference pin 42 for positioning the roof and others of the vehicle body 100.

For instance, as illustrated in FIG. 2, welding robots 50 are disposed at desired positions near lateral sides of the jig frame structure 2. Each of the welding robots 50 includes an arm 51 and a welding gun 52, the arm 51 being movable relative to the vehicle body 100, the welding gun 52 being supported on the end of the arm 51. The welding gun 52 performs spot welding on what is called interstitial free (IF)

steel, and includes a movable side electrode 52*a* and a fixed side electrode 52*b*, the movable side electrode 52*a* being movable along a pressure axis defined at the end of the arm 51, the fixed side electrode 52*b* being opposed to the movable side electrode 52*a* and fixed on the pressure axis of the movable side electrode 52*a* to clamp a welding section together with movement of the movable side electrode 52*a* and to perform spot welding with a predetermined pressure force.

Each functional unit of the manufacturing apparatus 1 configured as described above is provided with various control panels (not illustrated) and those control panels are collectively controlled by a program or the like that is installed in a process control panel 55, and thus, for instance the pre-assembly welding process illustrated in FIGS. 9 and 10 is performed.

Specifically, when the vehicle body 100 is transported from another process to the present process (pre-assembly welding process) (step S101), the process control panel 55 reads an identifier of the vehicle body 100 in step S102, and checks to see whether or not the vehicle body 100 transported this time is different in vehicle type from a vehicle body 100 transported last time.

When the transported vehicle body 100 is determined to be different in vehicle type in step S102, the flow proceeds to step S103, and the process control panel 55 replaces the upper jig frame 7. Specifically, when the flow proceeds from step S102 to step S103, the process control panel 55 operates an upper jig transport robot 10 to transport the upper jig frame 7 currently held by the upper jig transport robot 10 to the jig storage so that the upper jig frame 7 is separated from the upper jig transport robot 10. Subsequently, the process control panel 55 moves the upper jig transport robot 10 to a jig storage corresponding to the current vehicle type, and connects a new relevant upper jig frame 7 to the upper jig transport robot 10, then the flow proceeds to step S104. It is to be noted that in such replacement of the upper jig frame 7, for instance when the difference between vehicle types is only the difference between sedan type and wagon type vehicle bodies, it is sufficient to replace the upper jig frame rear 7*b* only.

On the other hand, in step S102, when it is determined that the vehicle body 100 transported this time is the same as the vehicle body 100 transported last time in vehicle type, the flow proceeds to step S104.

When the flow proceeds from step S102 or step S103 to step S104, the process control panel 55 causes the jig reference pin 15 provided in the underfloor jig 5 to extend to the side jig frame 6 to clamp the underfloor jig 5.

In subsequent step S105, the process control panel 55 causes the movable jig frame 6*a* of the side jig frame 6 to extend to the side structure 102 to clamp the side structure 102 with the side reference pin 16.

In subsequent step S106, the process control panel 55 operates the upper jig transport robot 10 to insert the jig frame bodies 8 of the upper jig frame 7 (the upper jig frame front 7*a* and the upper jig frame rear 7*b*) into the vehicle body 100 from the front and rear.

When the fitting member 23 provided in the leg 9 of the upper jig frame 7 is positioned at the fitting receiving member 24 provided in the side jig frame 6, the process control panel 55 causes in step S107 the air cylinder 21 to operate to lock the leg 9 of the upper jig frame 6 with the frame locking mechanism 20. Furthermore, the process control panel 55 causes the pin clamp cylinder 26 of the connection mechanism 25 to operate to lock between the jig frame bodies 8 in the front and rear.

When the jig frame structure 2, which supports the vehicle body 100, is assembled in these processes, the process control panel 55 causes the upper clamp jig 41 to extend to a clamp position of the work 104 in step S108 and causes the upper reference pin 42 to extend to a clamp position for the roof of the vehicle body 100.

In subsequent step S109, the process control panel 55 causes the upper side clamp jig 31 to extend and clamp the work 103. Specifically, the process control panel 55 causes the cylinder 32*a* of the pressing jig 32 to extend to the work 103 to press the work 103 from the inside of the vehicle body 100 with the pressing member 32*b*. Also, the process control panel 55 operates the cylinder 33*a* of the regulating jig 33 to cause the distal end of the rod 33*b* to project outward of the vehicle body 100, then causes the retaining member 33*c* to perform bending operation, thereby retaining the work 103 from the outside.

In subsequent step S110, the process control panel 55 operates the welding robot 50 to perform spot welding (pre-assembly welding) on the work 103 clamped by the upper side clamp jig 31.

After the spot welding on the work 103 is finished, the flow proceeds to step 111 where the process control panel 55 retracts the pressing member 32*b* and the retaining member 33*c* of the upper side clamp jig 31 from the work 103. Thus, the clamped state of the work 103 made by the upper side clamp jig 31 is released.

In subsequent step S112, the process control panel 55 retracts the upper clamp jig 41 from the clamp position of the work 104, and retracts the upper reference pin 42 from the clamp position for the roof of the vehicle body 100.

In subsequent step S113, the process control panel 55 causes the air cylinder 21 to operate and release (unlock) locking of the leg 9 by the frame locking mechanism 20. In addition, the process control panel 55 causes the pin clamp cylinder 26 of the connection mechanism 25 to operate and unlock between the jig frame bodies 8 in the front and rear.

In subsequent step S114, the process control panel 55 causes the movable jig frame 6*a* of the side jig frame 6 to operate and retract the side reference pin 16 from the side structure 102.

In subsequent step S115, the process control panel 55 causes the upper jig transport robot 10 to operate and move the upper jig frame 7 to a retract position.

In subsequent step S116, the process control panel 55 unclamps the underfloor jig 5 by retracting the jig reference pin 15 from the jig frame 6.

In subsequent step S117, the process control panel 55 transports the vehicle body 100 along with the underfloor jig 5, and the flow is exited.

According to the implementation, the manufacturing apparatus 1 for the vehicle body 100 includes: the side jig frames 6 disposed on the right and left sides of the vehicle body 100; a pair of upper jig frames 7 (the upper jig frame front 7*a* and the upper jig frame rear 7*b*) installed between the side jig frames 6, the upper jig frames 7 including a pair of front and rear frame members insertable into the inside of the vehicle body 100 through the front and rear openings of the vehicle body 100, respectively; the connection mechanism 25 that removably connects insertion ends of the jig frame bodies 8 of the upper jig frames 7; and the clamping mechanism 30 that is held on the upper jig frames 8 and that positions the vehicle body 100. Thus, it is possible to ensure a work space on the sides of the vehicle body 100 and to position the work 103 of the vehicle body 100 accurately.

That is, the upper jig frame 7 installed between the side jig frames 6 is formed to be divided into the pair of the upper jig frame front 7*a* and the upper jig frame rear 7*b* in the front and rear, which are made to be connectable by the connection mechanism 25, and are insertable into the inside of the vehicle body 100 through the front and rear openings of the vehicle body 100, and the clamping mechanism 30, which positions the vehicle body 100, is held on the upper jig frames 8 that are inserted into the inside of the vehicle body 100, thereby making it possible to ensure a sufficient work space on the sides of the vehicle body 100 and to position the work 103 of the vehicle body 100 accurately.

Therefore, it is possible to move the welding gun 52 to a welding position of the work 103 from any direction and angle to allow pre-assembly welding operation with favorable workability. In addition, since a sufficient work space is ensured on the sides of the vehicle body 100, additional welding after the pre-assembly welding may be achieved in the same process.

The present invention is not limited to the implementation described above and various modifications and changes may be made, and those modifications and changes are also within a technical scope of the present invention.

The invention claimed is:

1. A vehicle body manufacturing apparatus for welding a first part of a vehicle body to a second part of the vehicle body comprising: front sides jig frames and rear sides jig frames disposed respectively on right and left sides and front and rear sides of the vehicle body; at least one upper jig frame installed between the front sides jig frames, and the atleast one upper jig frame installed between rear sides jig frames, respectively, the upper jig frame including a front frame member and a rear frame member insertable into an inside of the vehicle body, the front frame member is inserted into the vehicle body through a front opening and the rear frame member is inserted into the vehicle body through a rear opening; the atleast one upper jig frame is installed between upper portions elevated from a base of the vehicle body manufacturing apparatus, of the front sides jig frames and the atleast one upper jig frame is installed between upper portions, elevated from the base of the vehicle body manufacturing apparatus, of rear sides jig frames; the front frame member and the rear frame member are horizontal and have a height lower than that of the vehicle body such that the front frame member and the rear frame member can be inserted into the vehicle body through the front and rear openings, which are front and rear windshield openings of the vehicle body, respectively; a connection mechanism that removably connects insertion ends of the front frame member and the rear frame member; and a clamping mechanism that is held on the at least one upper jig frame and that positions the vehicle body, the clamping mechanism including a pressing jig extending from the clamping mechanism to a position inside the vehicle body and that presses the work of the vehicle body in an outward direction relative to the inside of the vehicle body to weld the second part to the first part.

2. The vehicle body manufacturing apparatus according to claim 1, wherein the clamping mechanism further includes: a regulating jig that regulates outward movement of the first part from the vehicle body due to the pressing jig.

3. The vehicle body manufacturing apparatus according to claim 1, wherein the front frame member and the rear frame member are replaceable according to a vehicle type.

4. The vehicle body manufacturing apparatus according to claim 2, wherein the front frame member and the rear frame member are replaceable according to a vehicle type.

5. The vehicle body manufacturing apparatus according to claim 1, wherein the upper jig frame includes: a jig frame body that extends in a fire-and-aft direction of the vehicle body; and a leg that extends to a right and a left side under a front end of the jig frame body.

6. The vehicle body manufacturing apparatus according to claim 1, wherein the clamping mechanism is disposed at a position below an uppermost portion of the vehicle body.

7. The vehicle body manufacturing apparatus according to claim 1, wherein the vehicle body is positioned entirely from clamping an inside portion of the vehicle body via the clamping mechanism.

8. The vehicle body manufacturing apparatus according to claim 1, wherein the clamping mechanism clamps the vehicle body from an under surface of a roof of the vehicle body.

9. The vehicle body manufacturing apparatus according to claim 1, wherein the connection mechanism comprises: a male connection piece disposed on one of the front frame member and the rear frame member; and a female connection piece disposed on the other of the front frame member and the rear frame member, wherein the front frame member and the rear frame member are removably connected to each other via the male connection piece and the female connection piece.

* * * * *